US005740709A

United States Patent [19]

Boston et al.

[11] Patent Number: 5,740,709

[45] Date of Patent: Apr. 21, 1998

[54] TWO STAGE CONTINUOUS WEB CUTTING SYSTEM AND METHOD

[75] Inventors: William A. Boston; Frank A. Balow, both of Western Springs, Ill.

[73] Assignee: Goss Graphic Systems, Inc., Westmont, Ill.

[21] Appl. No.: 701,182

[22] Filed: Aug. 21, 1996

Related U.S. Application Data

[63] Continuation of Ser. No. 220,122, Mar. 30, 1994, abandoned.

[51] Int. Cl.[6] ..... B26D 1/62

[52] U.S. Cl. ..... 83/308; 83/346

[58] Field of Search ..... 83/303, 343, 345, 83/346, 368

[56] References Cited

U.S. PATENT DOCUMENTS

| | | | |
|---|---|---|---|
| 2,261,315 | 11/1941 | Thorsen | 83/303 |
| 4,397,204 | 8/1983 | Colombo | 83/303 |
| 4,809,573 | 3/1989 | Welch | 83/368 |
| 5,079,981 | 1/1992 | Singer et al. | 83/368 |
| 5,230,268 | 7/1993 | Richter | 83/303 |

*Primary Examiner*—Maurina T. Rachuba
*Attorney, Agent, or Firm*—Marshall, O'Toole, Gerstein, Murray & Borun

[57] ABSTRACT

A web-cutting arrangement uses two-stage cutting to produce a plurality of products from a continuous web (100), while ensuring that the web, and the products (125) cut therefrom, remain continuously guided and undamaged. The arrangement includes a leading cutting structure (170) which provides an initial partial cut (115) into the web. The partial cut (115) is made along a line (110) directed perpendicular to the web length, leaving a remaining uncut portion (120) along the line (110). Using web transport belts (140) located so as to overlap the cutout (or partially cut) portions of the web (100), the continuous web is moved in a direction parallel to the web length with the belts (140) pulling and guiding the web (100) around rotating cylinders (164, 166). A downstream cutting structure (180), having knife edges (210, 212, 214), is located and arranged adjacent but not interfering with the web-guiding belts (140) to cut the remaining uncut portion of the web along the same line (110), while the web-guiding belts (140) are guiding the web (100). An additional feature addresses situations in which the downstream cutting structure (180) would otherwise cut at the wrong place, i.e., not exactly along the same line where the partial cutout is provided. This problem is eliminated by providing a controlling mechanism (190) to adjust the point at which the cutting structure (180) contacts the continuous web (100) to finish the cut.

7 Claims, 4 Drawing Sheets

TWO STAGE CONTINUOUS WEB CUTTING SYSTEM AND METHOD

This is a continuation of application Ser. No. 08/220,122, filed Mar. 30, 1994 now abandoned.

FIELD OF THE INVENTION

The present invention relates to the practice of separating sections of a continuous web into individual signatures or products by cutting the web at various points as it is being fed along a cutting or folding machine. The term "product" in this context refers not only an item which is eventually sold to a customer, but also to an item which is used as part of, or in preparation for, an item which produced from the end of a continuous web.

BACKGROUND OF THE INVENTION

In the rotary web-fed printing industry, it is common for a continuous web to be printed and then cut into smaller individual pieces. These individual pieces are then typically folded to provide "signatures" or "products." After being cut, the signatures are commonly used as pages of magazines, journals, flyers, books and the like.

The cutting process is accomplished by passing the continuous web(s) between a cutting knife and an opposing resist surface. Commonly, the knife is toothed, and the resist surface may be a slot, anvil, or relatively soft material into which the knife may penetrate. The knife and resist surface are mounted in a rotating cylinder so they may rotate or move in conjunction with the moving web. As the cylinders rotate and the knife engages the resist surface, a portion of the web is cut. The moving web is cut repeatedly, normally in equal repeat lengths, such that many of these separate portions, or products, are produced. Each of these products may or may not be further processed by folding and delivery in some usable manner. Once the product has been cut, some means of controlling its movement must be supplied because it is no longer part of the continuous web.

One method of supplying this control is to pierce the web (or product) with a series of pointed pins across the web, behind the cut and parallel to it. These pins are used to carry or transport the product to its next process step.

Another method of transporting the product is between a series of belts or tapes. This method has the advantage of not marking the product as in the case with the impaling pins. This type of folder is commonly referred to as a "pinless" folder.

Because pinless folders have no pins to take control of the products before being cut, the leading edge of the cut product must pass across an open space before it enters the tape section which, then guides the leading edge of the separated product. As the leading edge traverses this open passage, the product is essentially uncontrolled, and this is a problem because the product can escape.

To help control the product and avoid this problem, one approach has been to deform the web in a corrugated fashion, such that the corrugations are parallel to the direction of travel. These corrugations provide stiffness or bending resistance to help the product travel straight to its desired destination into the tape section. In the process of forming these corrugations, however, the products may be marked or otherwise detrimentally treated.

Another common element of such pinless machines is to include perforating cylinders. These are used in machines that have subsequent folding actions. The perforator cylinders contain a knife/resist arrangement similar to the cutting knives described earlier. However, in this case they perforate, in a non-continuous fashion, across the web. Their purpose is to provide a weak area (line) for folding or providing a tear out section.

Accordingly, the known practices for separating a continuous web into individual products are disadvantageous. There is, therefore, a need for a continuous web cutting system and method which overcomes the above deficiencies of the prior art.

SUMMARY OF THE INVENTION

The present invention provides a system and method for separating a continuous web into individual products without damaging the products or permitting the web or the products to pass through an uncontrolled area.

The present invention eliminates the uncontrolled passage of the cut lead edge of the product from the cutting cylinders to the tape section described earlier in connection with known pinless implementations.

In one embodiment, the present invention utilizes the cutting action as two sets of cutting cylinders, or one set of cutting cylinders and one set of perforating cylinders. One continuous cut across the web is accomplished in two separate cutting actions, with each action staggered across form the other by each of the two sets of cylinders. Each set of the cutting cylinders provides portions of the total cut sot that together, the cut is continuous and complete. The first set of cutting cylinders provides a series of cuts across the web in a non-continuous manner. The web is then guided to the next set of cutting cylinders where the remainder of the necessary cuts are made along the same line as the first set of cuts. This results in a continuous cut across the web to separate a product from the web at this line. By making a dual cut in this fashion, the previously addressed problem of not being able to have the transport tapes start at, or ahead, of the cutting action is eliminated.

Preferably, as part of a web transport system, web transporting tapes are arranged along the direction of the moving web such that they pass between the cutting edges of the second set of cutting cylinders and overlap (or are in line with) the portion of the web that was cut by the first set of cutting cylinders. In this manner, the tapes guide and control the continuous web before and after the product is separated from the web at the second set of cutting cylinders. The tapes do not interfere with the first set of cutting cylinders, because they are co-located adjacent the second set of cutting cylinders. Neither do the tapes interfere with the cutting edges of the second set of cutting cylinders, because the tapes are arranged between the cutting edges so that the continuous web and the products separated therefrom are guided by the tapes.

In accordance with the present invention, a system for providing a plurality of products from a continuous web includes: a web guiding support structure having a web leading section and a web trailing section; a belt transport arrangement located along the web leading section; and a cutter structure, e.g., an anvil in combination with a cutting knife, located in the area of the belt transport arrangement. The web trailing section provides (or guides) the continuous web with at least one partial cutout section and at least one uncut section along a line oriented perpendicular to the web length. The belt transport arrangement includes a web guiding belt which guides the web in a direction parallel to the web length. The belt contacts the web over the partial cutout section.

The cutter structure can be arranged in various ways. In one implementation, the cutter has a least one cutting blade section and a least one recessed section. The cutting blade section is constructed and arranged to separate the continuous web into a first and second signature by cutting the web at the uncut section. The recessed section provides a gap for the belt to pass so that the belt continues to guide the web. In another embodiment, the cutter structure is implemented with the cutting blade section replaced by an opposing resist section against which a corresponding cutting blade engages from the other side of the web, so as to separate the product from the continuous web.

An additional feature of this system can be used in applications where there is a concern that the cutter structure may tend to cut at the wrong place, i.e., not exactly along the line perpendicular to the web length where the portion cutout thereon is provided. This concern is eliminated by using a tracking adjustment which adjust the point at which the cutter structure contacts the continuous web to cause the separation. For example, the cutter structure can be moved with respect its normal cutting position in response to a web position tracking signal, which tracks any slippage of the web as it is fed along the web guiding support.

Also in accordance with the principles and concepts herein, the present invention provides a method for separating a continuous web into a plurality of signatures, as described above. First, the continuous web is cut perpendicular to the web length to provide an alternate sequence of cut and uncut sections. The next step is to transport the web to another station by using a rotating belt running in a direction parallel to the length of the web and contacting the web over the cut sections. Using a cutter structure configured so that the guiding belt which contacts the continuous web passes between cutting edge structures, the line having the uncut sections is cut while the belt is guiding the continuous web so as to provide a separated section of the continuous web.

The above summary of the present invention is not intended to present each embodiment or every aspect of the present invention. This is the purpose of the figures and the associated description which follow.

BRIEF DESCRIPTION OF THE DRAWINGS

Other aspects and advantages of the present invention may become apparent upon reading the following detailed and upon reference to the drawings in which.

DETAILED DESCRIPTION OF THE DRAWINGS

The present invention has a wide variety of applications in environments requiring products to be formed by repeatedly separating the end of a continuous web of material. An exemplary application involves the formation of signatures for insertion into a book, a newspaper, magazine and the like. In this environment, a continuous web of paper is guided (and sometimes formed) along a web-cutting machine. As the web is being directed along the direction of its length, the end of the web needs to be separated, so as to form a web portion which is folded to form the signature (or product).

Figure 1:
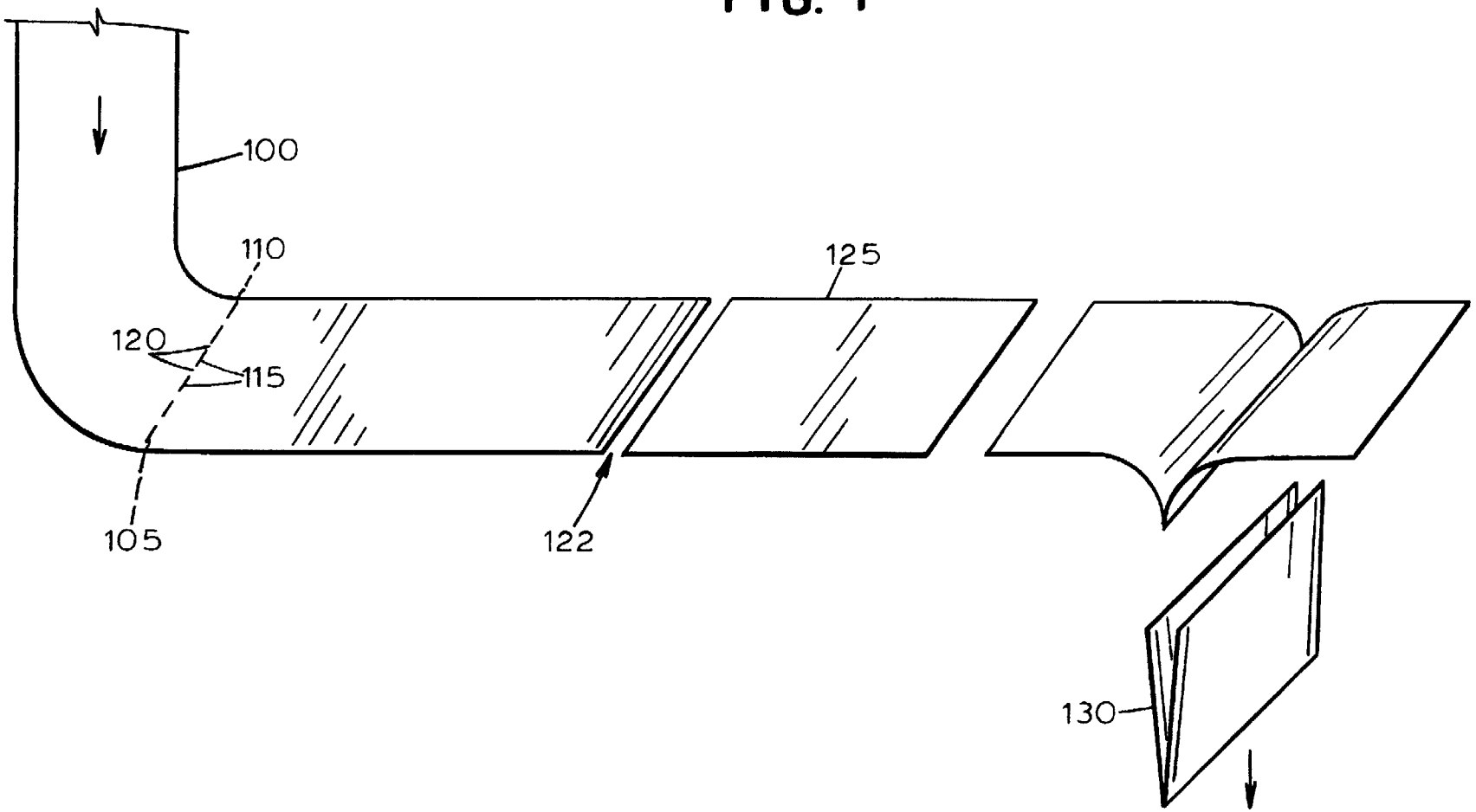
FIG. 1 is a schematic perspective view, according to the present invention, showing a product being cut from a continuous web.

Such an application is illustrated in FIG. 1, in which a continuous web 100 is shown being directed from the left to a first station at which a partial cut 105 is made along a line 110, which is perpendicular to the direction of web movement. The partial cut 105, which includes cutout portions 115 and uncut portions 120, defines the end of a product 125 to be removed from the rest of the web 100. By making this cut 105 only partial, as the web 100 moves past the partial cut position of the first station, the web 100 remains intact in its continuous form which permits it to be guided by a single transport system (not shown in FIG. 1) located downstream from the partial cut position of the first station.

After the partial cut 105 is made at the first station, the web 100 is directed to a second station at which a second cut 122 is made along the same line 110 to complete the cut made at the first station. The resultant product, which is depicted as 125, can then be used as is or further processed, for example, by folding or slitting to form a signature insert 130 for a magazine.

Figure 2:
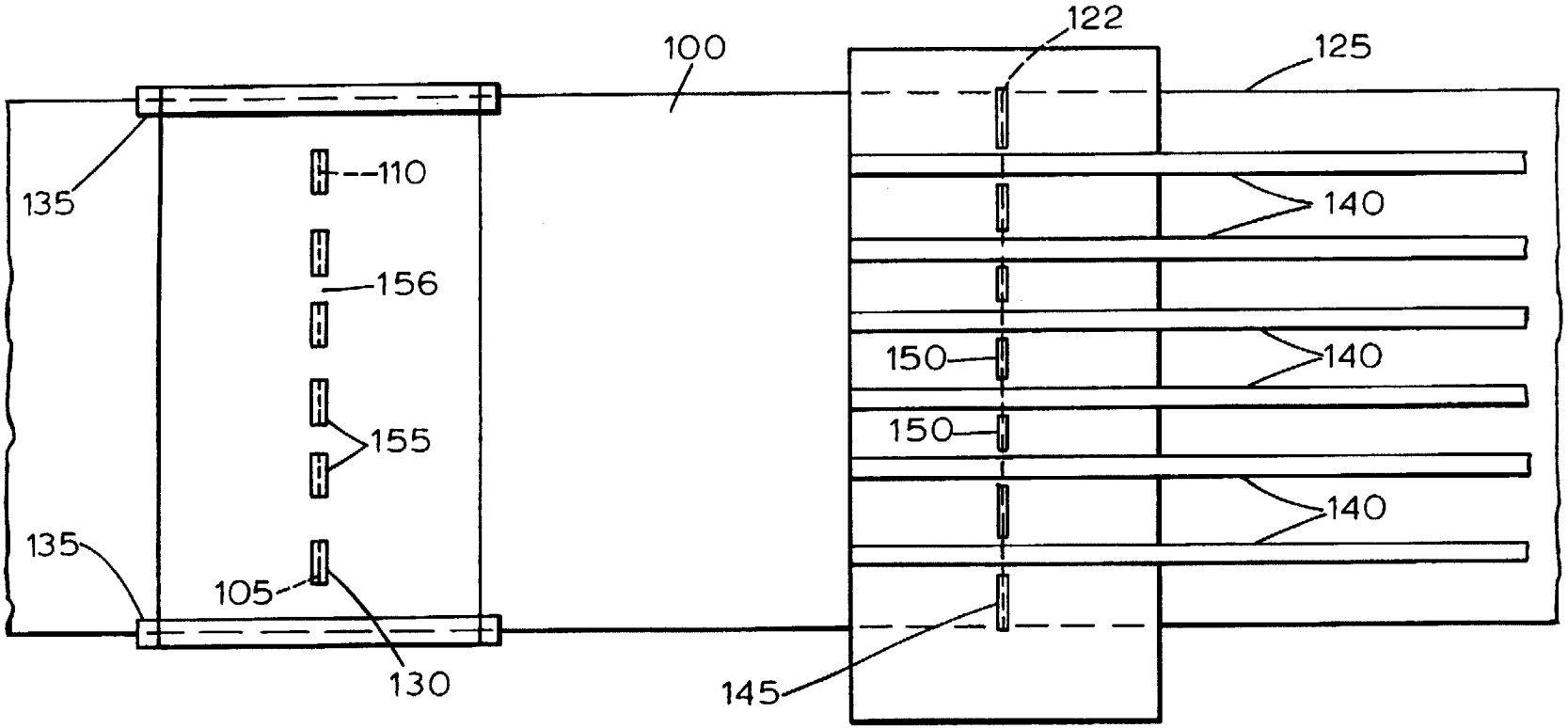
FIG. 2 is a schematic top view of the product and the continuous web of FIG. 1.

The product-making process illustrated in FIG. 1 is further illustrated in FIG. 2, using a top-down schematic perspective of the web 100. The partial cut 105 is made at line 110 by a first cutting structure 130, such as a multi-edged knife. A set of nip rings 135 may be used to guide the web 100 as a web transport system, which pulls the web 100 from the left to the right using tapes (or belts) 140.

Using a second, similarly arranged cutting structure 145, the complete cut 122 is made along the same line 110 once the tapes 140 pull this section of the web 100 to the second station.

The tapes 140 are arranged between edges 150 of the second cutting structure 145 so that the web 100 can be pulled from left to right while the complete cut 122 is being made. This continuous pulling or guidance feature is significant in that it overcomes the deficiencies previously noted in connection with the prior-art pinless system.

To realize the complete cut 122, the edges 150 of the second cutting structure 145 are offset from the edges 155 of the first cutting structure 130. The length of each edge 150 of the second cutting structure 145 is preferably slightly longer than the length of the each space 156 of the first cutting structure 130. This ensures that the entire remaining uncut portion of the web 100 is completely cut and that the web 100 does not tear or rip.

Figure 3:
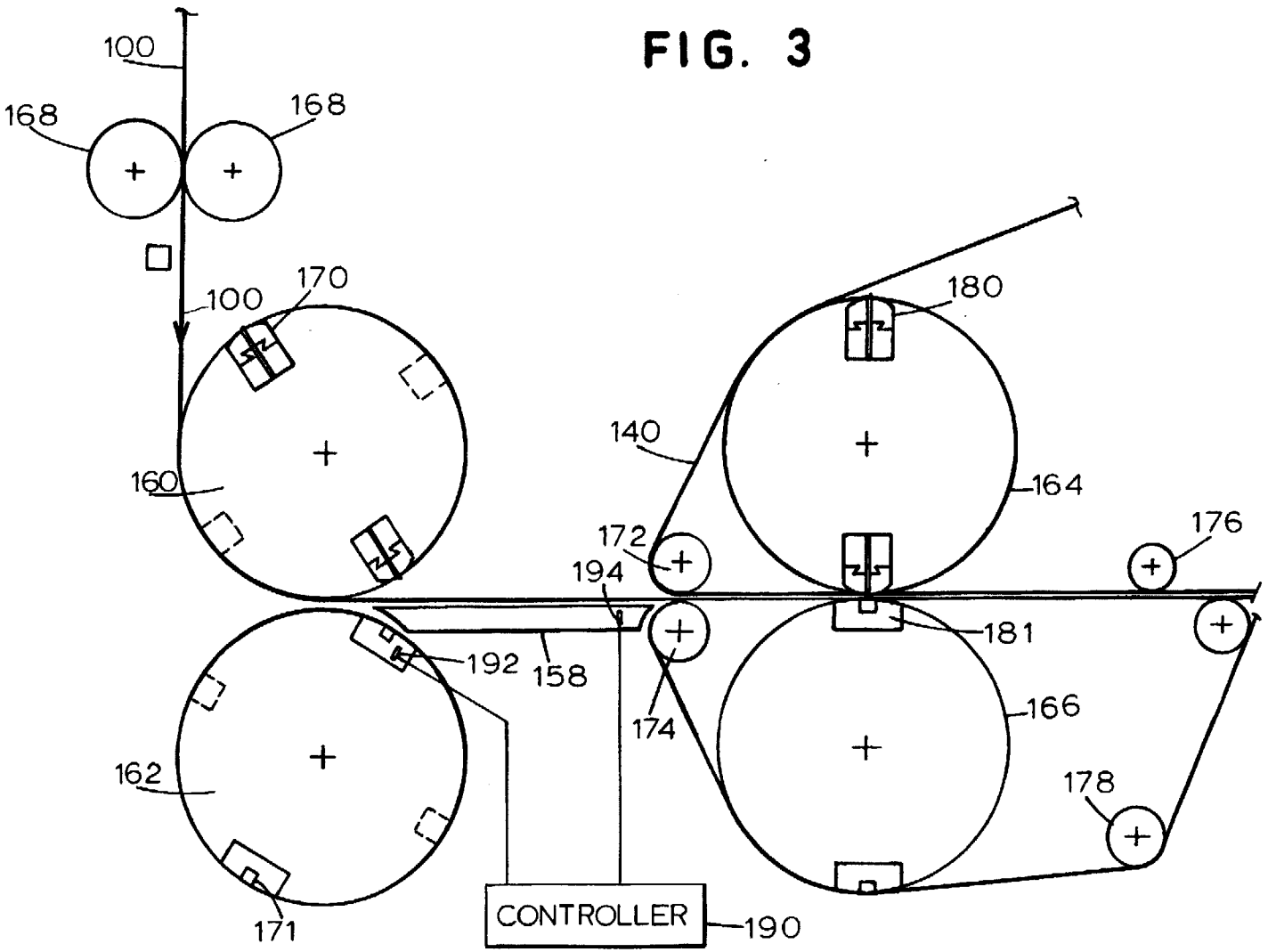
FIG. 3 is a side view of a system, in accordance with the principles of the present invention, for providing a plurality of products from a continuous web.

Referring now to FIG. 3, a cutting system embodying the principles of the present invention is illustrated. The system includes a web-guiding platform 158, a first pair of rotating cylinders 160, 162 located to the left side of the platform 158 and a second pair of rotating cylinders 164, 166 located to the right side of the platform 158. The first pair of rotating cylinders 160, 162, each of which rotates in opposite direction as the web 100 moves around the cylinders 162, 164 may include a set of nip rollers 164 (FIG. 1) to guide the web 100 during such movement and at least one cutting structure 170, 171, which is used to make the partial cut 105 (FIGS. 1 and 2). The cutting structure 170 can be constructed using a series of knife edges, depicted as element 170, which meets an opposing resist surface, such as an anvil, depicted as element 171.

From the first pair of rotating cylinders 160, 162 and after the partial cut 105 is made, the web 100 is guided over the platform 158 toward the second pair of cylinders 164, 166. Rotating tape carriers 172, 174, 176, 178 are used to transport (or pull) the web 100 from the nip rollers 168 around the cylinder 160 and between the second pair of cylinders 164, 166. The tape carriers 172, 174, 176, 178, which are also cylindrically shaped, carry tapes 140 which are arranged along the length of the carriers such that the tapes 140 overlap the cutout portions (115 of FIG. 1) of the web 100. Similar to the arrangement of the first pair of rotating cylinders 160, 162, each of the second pair of rotating cylinders 164, 166 includes at least one cutting structure 180. As with the first pair of cylinders, the cutting structure 180 can be constructed using a series of knife edges (offset from the knife edges of the first pair of cylinders), which meet an opposing resist surface(s), such as an anvil, depicted as element 181. For either cutting structure 170, 171 or 180, 181, the knife edges can be interchanged with the opposing resist surface such that the cutting edge initially strikes the bottom surface of the web 100. Other cutting arrangements can also be used.

Accordingly, the web-pulling tapes 140 are located between the edges 150 (FIG. 2) of the cutting structure 180, permitting the web 100 to be pulled after the initial partial cut 105 (FIG. 1) is made and providing continued control over the product 125 (FIGS. 1 and 2) after it is severed from the remainder of the continuous web 100.

Another important aspect of the present invention is directed to applications where there is a concern that the cutter structure may tend to cut the web 100 at a location other than exactly along the designated cutting line 110. In accordance with the present invention, this concern is eliminated by using a tracking adjustment controller 190 which responds to cutting misalignment indicator by adjusting the point at which the cutter structure 180, 181 contacts the continuous web to cause the separation. As an alternative, the controller 190 can also be implemented using a manually-adjusted phasing arrangement, rather than an automatic one.

The tracking adjustment controller 190 can be implemented a number of different ways. For example, by using a cutting line sensor 192 secured to the cutting structures 171 on cylinder 162 and a downstream sensor 194 on the platform 194, any skewing of the web 100 can be determined (e.g., calculated using a microcomputer within the controller 190) in advance of the cutting action by the second pair of cylinders 164, 166. This skewing measurement can then be used to move the center axis of the cylinders 164, 166 to account for the skew.

Figure 4:
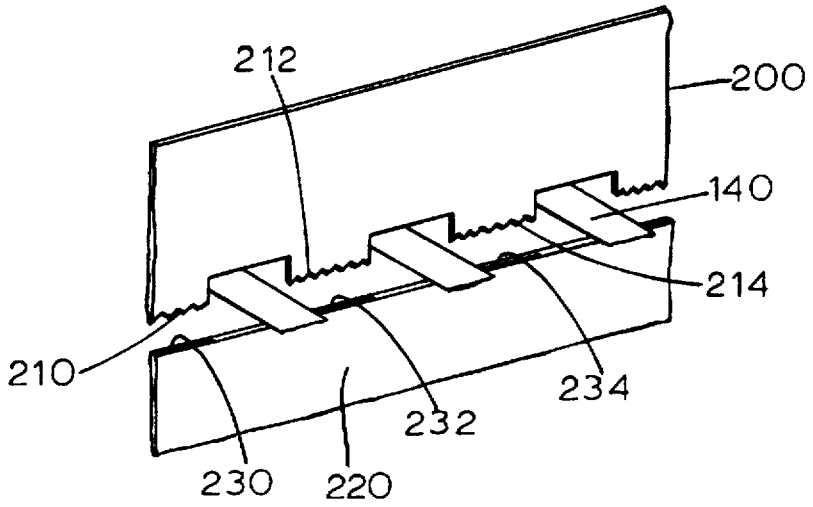
FIG. 4 is a perspective view of a cutter mechanism, according to the present invention, which may be used in the systems of FIGS. 3 and 4.
Figure 5:
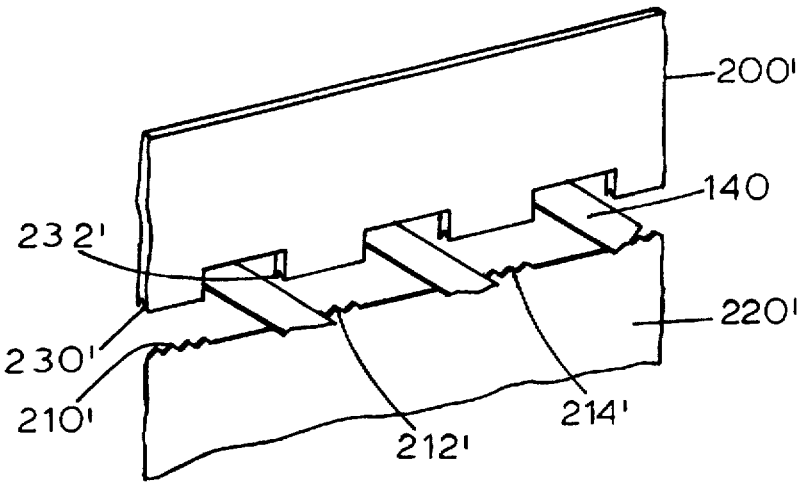
FIG. 5 is a perspective view of an alternative cutter mechanism, according to the present invention, which may be used in the systems of FIGS. 3 and 4.

FIGS. 4 and 5 shows alternative cutter assemblies, also in accordance with the present invention, which may be used in the system of FIG. 3. The assembly of FIG. 4 includes a rigid cutting structure 200 having knife edges 210, 212 and 214. The cutting structure 200 would be secured to the rotating cylinder 164 and corresponds to one of the cutting structures 180 of FIG. 3. The knife edges 210, 212 and 214 are arranged with a spacing therebetween to permit passage of the tapes 140, while the edges engage opposing resist surfaces 230, 232 and 234 on a rigid structure 220 to cut the uncut portion of the web along the line (110 of FIGS. 1, 2). The rigid structure 220 corresponds to one of the cutting structure 181 of FIG. 3 and is secured to the rotating cylinder 164.

The alternative assembly of FIG. 5 essentially interchanges the knife edges 210, 212 and 214 with the resist surfaces 230, 232 and 234. Thus, the knife edges 210', 212' and 214' are arranged on the structure 220 and the opposing resist surfaces 230', 232' and 234' are arranged on the rigid structure 220 with a spacing therebetween to permit passage of the tapes 140, while the edges engage the opposing resist surfaces to cut the uncut portion of the web along the line (110 of FIGS. 1, 2).

The principles of the present invention, which have been disclosed in connection with the above examples, can be implemented using various types of materials and machines. The knife edges for instance can be implemented using a serrated-toothed type knife that can be pressed against the opposing resist surfaces for a clean cut through the web which, in the above-illustrated application, is paper. The opposing resist surfaces can be implemented using a softer surface or web-like material. The remaining elements that are used to implement the system shown in FIG. 3 are conventional and are used in such commercial machines as the instant assignee's C500 and C700 lines of web-cutting equipment.

Those skilled in the art will readily recognize that various modifications and changes may be made to the present invention without strictly following the exemplary application illustrated and described herein and without departing from the true spirit and scope of the present invention, which is set forth in the following claims.

We claim:

1. A web-cutting system for providing a product from a continuous web, comprising:

a web guiding arrangement having a partial-cut section and a finishing-cut section;

a primary cutting structure located adjacent the partial cut section, for providing a partially-cut segment in the continuous web along a cut line perpendicular to the web length, the partially-cut segment having a portion thereof cutout and a remaining portion thereof uncut;

a transport arrangement for moving the web in a direction parallel to the web length;

a secondary cutting structure spaced downstream from the primary cutting structure adjacent the finishing-cut section, including at least one cutting mechanism constructed and arranged for cutting the remaining uncut portion of the partially-cut segment along the cut line to provide the product;

means for sensing the cut line defined by the cutout portion of the web as provided by the primary cutting structure; and means responsive to the sensing means for ensuring that the location of the secondary cutting structure in relation to the primary cutting structure will position the cutting mechanism of the secondary cutting structure to cut the remaining uncut portion of the partially-cut segment exactly on the cut line to provide the product.

2. A web-cutting system, according to claim 1, wherein the at least one cutting mechanism of the secondary cutting structure includes a cutting edge.

3. A web-cutting system, according to claim 1, wherein the at least one cutting mechanism includes a blade-receiving structure for receiving a cutting edge.

4. The web-cutting system of claim 1 wherein the location ensuring means comprises means for moving the secondary cutting structure to adjust the skew of the web.

5. The web-cutting system of claim 1 wherein:

the primary cutting structure comprises first and second rotating cylinders; and the secondary cutting structure comprises third and fourth rotating cylinders.

6. The web-cutting system of claim 5 wherein the transport arrangement includes a plurality of web-guiding belts, the web-guiding belts contacting the web over the cutout portion of the web.

7. The web-cutting system of claim 5 comprising means for moving the axes of the third and fourth cylinders in relation to the axes of the first and second cylinders to adjust for skew of the web.

* * * * *

UNITED STATES PATENT AND TRADEMARK OFFICE

CERTIFICATE OF CORRECTION

PATENT NO. : 5,740,709

DATED : April 21, 1998

INVENTOR(S) : Boston et al.

It is certified that error appears in the above-identified patent and that said Letters Patent is hereby corrected as shown below:

Column 3, line 18, please delete "adjust" and insert in its place --adjusts--;

Column 4, line 2, after "book," please delete "a";

Column 5, line 35, after "to" please insert --a--;

Column 5, line 64, please delete "structure" and insert in its place --structures--; and Column 6, line 64, please delete "the" and insert in its place --for--.

Signed and Sealed this

Fifteenth Day of December, 1998

Bruce Lehman

*Attest:*

BRUCE LEHMAN

*Attesting Officer*

*Commissioner of Patents and Trademarks*